US005855338A

United States Patent [19]

Berger

[11] Patent Number: 5,855,338

[45] Date of Patent: Jan. 5, 1999

[54] MULTI-ROLL TOILET PAPER HOLDING DEVICE

[76] Inventor: Seymour Berger, 214 Lily St. Apt. 4A, Paterson, N.J. 07522

[21] Appl. No.: 65,951

[22] Filed: Apr. 24, 1998

[51] Int. Cl.[6] ..... B65H 19/12

[52] U.S. Cl. ..... 242/560; 242/597.7

[58] Field of Search ..... 242/559.4, 560, 242/560.2, 597.7

[56] References Cited

U.S. PATENT DOCUMENTS

| | | | |
|---|---|---|---|
| 3,157,370 | 11/1964 | Govatsos et al. | 242/598.5 |
| 3,295,777 | 1/1967 | Carroll | 242/560.2 |
| 4,177,958 | 12/1979 | Poole | 242/560 |
| 4,314,679 | 2/1982 | Paul et al. | 242/560.3 |
| 4,463,912 | 8/1984 | Grunerud | 242/560.2 |
| 4,607,809 | 8/1986 | Sineni et al. | 242/560 |
| 4,989,800 | 2/1991 | Tritch | 242/560.2 |
| 5,597,133 | 1/1997 | Teague | 242/560.3 |

*Primary Examiner*—John P. Darling

[57] ABSTRACT

A multi-roll toilet paper holding device including a support bracket including a back panel. The support bracket includes upper and lower panels. The upper and lower panels extend outwardly from respective upper and lower ends of the back panel. The lower panel has a recess extending inwardly of an outer edge thereof. A support rod is pivotally coupled with respect to the support bracket. The support rod holds a plurality of rolls of toilet paper thereon. The support rod has an upper end pivotally coupled with respect to the upper panel. The support rod has a narrow extension extending downwardly from a lower end thereof. The narrow extension is dimensioned for being received within the recess of the lower panel.

5 Claims, 2 Drawing Sheets

MULTI-ROLL TOILET PAPER HOLDING DEVICE

BACKGROUND OF THE INVENTION

1. Field of the Invention

The present invention relates to a multi-roll toilet paper holding device and more particularly pertains to holding a plurality of rolls of toilet paper for easy retrieval with a multi-roll toilet paper holding device.

2. Description of the Prior Art

The use of toilet paper dispensers is known in the prior art. More specifically, toilet paper dispensers heretofore devised and utilized for the purpose of dispensing toilet paper are known to consist basically of familiar, expected and obvious structural configurations, notwithstanding the myriad of designs encompassed by the crowded prior art which have been developed for the fulfillment of countless objectives and requirements.

By way of example, U.S. Pat. Nos. 4,463,912 to Grunerud; 4,607,809 to Sineni et al.; 4,314,679 to Paul et al.; 4,177,958 to Poole, 5,597,133 to Teague; and 4,989,800 to Tritch.

While these devices fulfill their respective, particular objective and requirements, the aforementioned patents do not describe a multi-roll toilet paper holding device for holding a plurality of rolls of toilet paper for easy retrieval.

In this respect, the multi-roll toilet paper holding device according to the present invention substantially departs from the conventional concepts and designs of the prior art, and in doing so provides an apparatus primarily developed for the purpose of holding a plurality of rolls of toilet paper for easy retrieval.

Therefore, it can be appreciated that there exists a continuing need for new and improved multi-roll toilet paper holding device which can be used for holding a plurality of rolls of toilet paper for easy retrieval. In this regard, the present invention substantially fulfills this need.

SUMMARY OF THE INVENTION

In the view of the foregoing disadvantages inherent in the known types of toilet paper dispensers now present in the prior art, the present invention provides an improved multi-roll toilet paper holding device. As such, the general purpose of the present invention, which will be described subsequently in greater detail, is to provide a new and improved multi-roll toilet paper holding device and method which has all the advantages of the prior art and none of the disadvantages.

To attain this, the present invention essentially comprises a support bracket including a vertically disposed back panel. The back panel is securable to a wall surface. The support bracket includes upper and lower horizontally disposed panels. The upper and lower panels extend outwardly from respective upper and lower ends of the back panel. The lower panel has a recess extending inwardly of an outer edge thereof. The upper panel has a pair of tabs extending downwardly from a lower surface thereof in a spaced relationship. The back panel has a support pin extending outwardly from a front surface thereof intermediate the upper and lower panels. The support pin has a length essentially equal to a length of the upper and lower panels. A support rod is pivotally coupled with respect to the support bracket. The support rod holds a plurality of rolls of toilet paper thereon. The support rod has an upper end with a transverse rod extending therethrough. The transverse rod extends between the pair of tabs of the upper panel of the support bracket. The transverse rod is rotatably coupled with pair of tabs. The support rod has a narrow extension extending downwardly from a lower end thereof. The narrow extension is dimensioned for being received within the recess of the lower panel.

There has thus been outlined, rather broadly, the more important features of the invention in order that the detailed-description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-roll toilet paper holding device which has all the advantages of the prior art toilet paper dispensers and none of the disadvantages.

It is another object of the present invention to provide a new and improved multi-roll toilet paper holding device which may be easily and efficiently manufactured and marketed.

It is a further object of the present invention to provide a new and improved multi-roll toilet paper holding device which is of durable and reliable construction.

An even further object of the present invention is to provide a new and improved multi-roll toilet paper holding device which is susceptible of a low cost of manufacture with regard to both materials and labor, and which accordingly is then susceptible of low prices of sale to the consuming public, thereby making such a multi-roll toilet paper holding device economically available to the buying public.

Even still another object of the present invention is to provide a new and improved multi-roll toilet paper holding device for holding a plurality of rolls of toilet paper for easy retrieval.

Lastly, it is an object of the present invention to provide a new and improved multi-roll toilet paper holding device including a support bracket including a back panel. The support bracket includes upper and lower panels. The upper and lower panels extend outwardly from respective upper and lower ends of the back panel. The lower panel has a recess extending inwardly of an outer edge thereof. A support rod is pivotally coupled with respect to the support bracket. The support rod holds a plurality of rolls of toilet paper thereon. The support rod has an upper end pivotally coupled with respect to the upper panel. The support rod has a narrow extension extending downwardly from a lower end thereof. The narrow extension is dimensioned for being received within the recess of the lower panel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
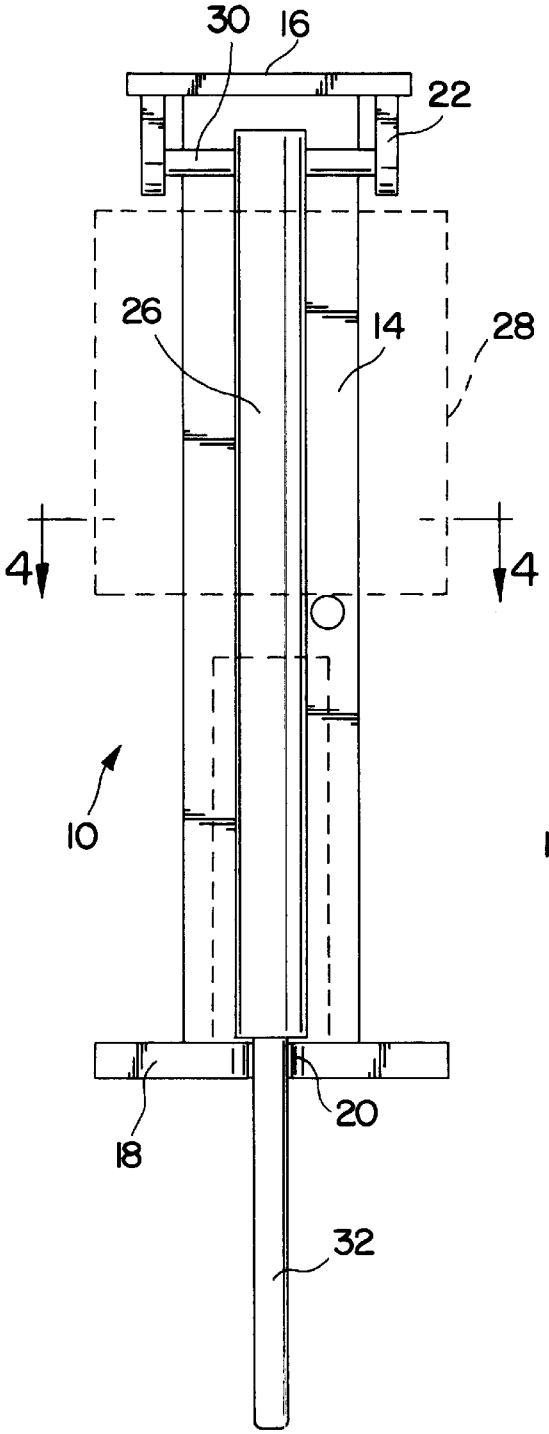
FIG. 1 is a perspective view of the preferred embodiment of the multi-roll toilet paper holding device constructed in accordance with the principles of the present invention.
Figure 2:
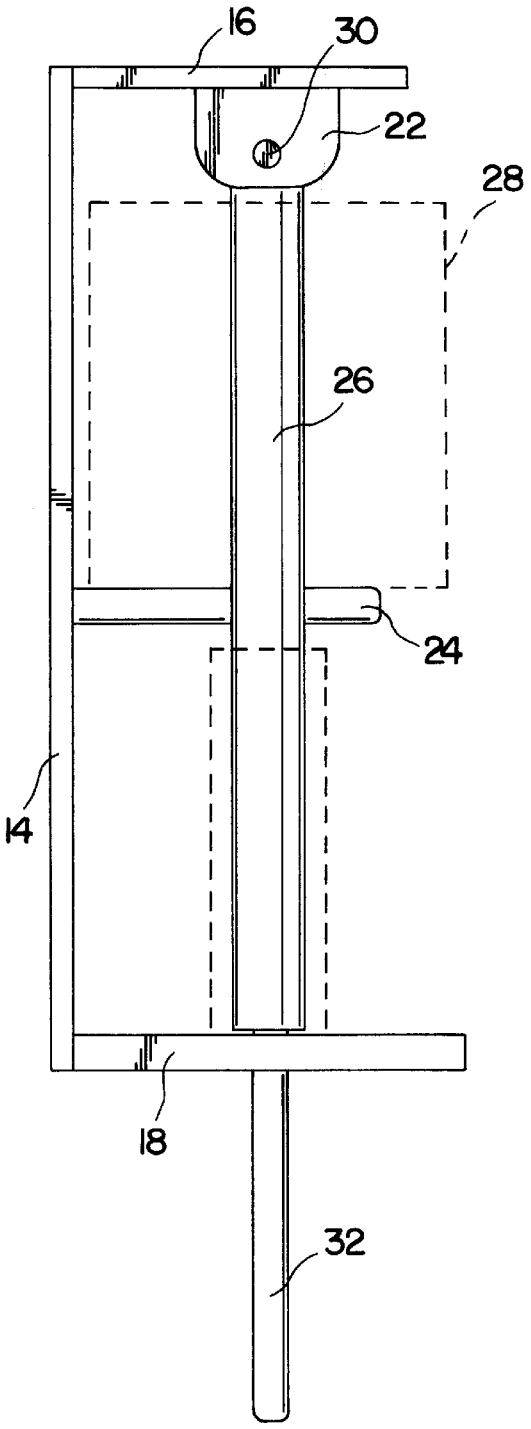
FIG. 2 is a side elevation view of the present invention.
Figure 3:
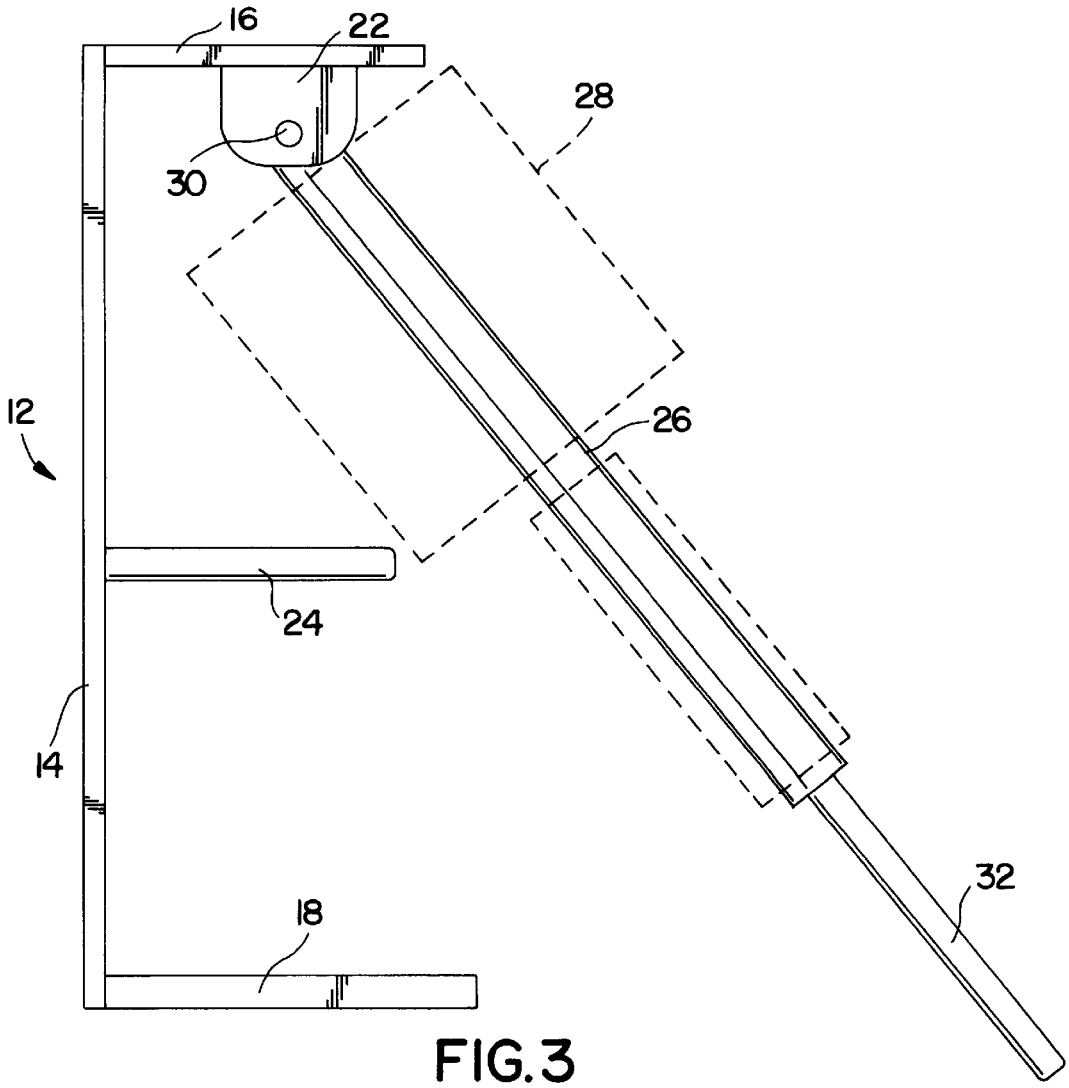
FIG. 3 is a side view of the present invention illustrated in use.
Figure 4:
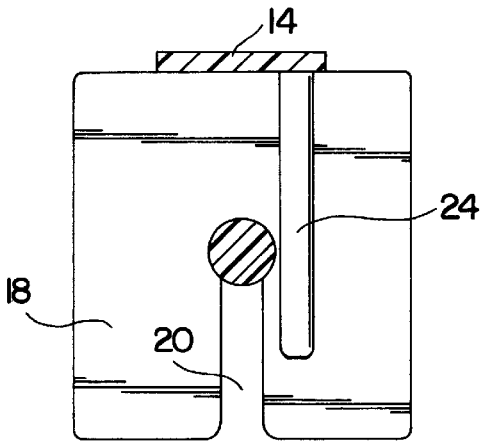
FIG. 4 is a cross-sectional view of the present invention as taken along line 4—4 of FIG. 1.

With reference now to the drawings, and in particular, to FIGS. 1 through 4 thereof, the preferred embodiment of the new and improved multi-roll toilet paper holding device embodying the principles and concepts of the present invention and generally designated by the reference number 10 will be described.

Specifically, it will be noted in the various Figures that the device relates to a multi-roll toilet paper holding device for holding a plurality of rolls of toilet paper for easy retrieval. In its broadest context, the device consists of a support bracket and a support rod. Such components are individually configured and correlated with respect to each other so as to attain the desired objective.

The support bracket 12 includes a vertically disposed back panel 14. The back panel 14 is securable to a wall surface. The back panel is secured to the wall surface via two threaded members. Alternately, the support bracket 12 could be built into the wall surface. The support bracket 12 is within reaching distance of a person seated on a toilet. The support bracket 12 includes upper and lower horizontally disposed panels 16,18. The upper and lower panels 16,18 extend outwardly from respective upper and lower ends of the back panel 14. The lower panel 18 has a recess 20 extending inwardly of an outer edge thereof. The upper panel 16 has a pair of tabs 22 extending downwardly from a lower surface thereof in a spaced relationship. The back panel 14 has a support pin 24 extending outwardly from a front surface thereof intermediate the upper and lower panels 16,18. The support pin 24 has a length essentially equal to a length of the upper and lower panels 16,18.

The support rod 26 is pivotally coupled with respect to the support bracket 12. The support rod 26 holds a plurality of rolls of toilet paper 28 thereon. The support rod 26 has an upper end with a transverse rod 30 extending therethrough. The transverse rod 30 extends between the pair of tabs 22 of the upper panel 16 of the support bracket 12. The transverse rod 30 is rotatably coupled with pair of tabs 22. The support rod 26 has a narrow extension 32 extending downwardly from a lower end thereof. The narrow extension 32 is dimensioned for being received within the recess 20 of the lower panel 18. A locking rod can be inserted within the narrow extension 32 to prevent the support rod 26 from being pulled outwardly with respect to the lower panel 18.

In use, the present invention, in the preferred embodiment, would support two rolls of toilet paper 28 on the support rod 26. A larger version could be produced to hold more than two rolls of toilet paper. A roll of toilet paper in use would be disposed below the support pin 24 while the other roll would be disposed above the support pin 24. Once the first roll of toilet paper is used up, the user would simply lift the support rod 26 outwardly so that the second roll of toilet paper can clear the support pin 24. The empty first roll would be removed and the second roll would slide downwardly below the support pin 24 whereby the support rod 26 would be returned to it's position within the recess 20 and the second roll of toilet paper would rest upon the lower panel 18 for use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A multi-roll toilet paper holding device for holding a plurality of rolls of toilet paper for easy retrieval comprising, in combination:

a support bracket including a vertically disposed back panel, the back panel being securable to a wall surface, the support bracket including upper and lower horizontally disposed panels, the upper and lower panels extending outwardly from respective upper and lower ends of the back panel, the lower panel having a recess extending inwardly of an outer edge thereof, the upper panel having a pair of tabs extending downwardly from a lower surface thereof in a spaced relationship, the back panel having a support pin extending outwardly from a front surface thereof intermediate the upper and lower panels, the support pin having a length essentially equal to a length of the upper and lower panels;

a support rod pivotally coupled with respect to the support bracket,.the support rod holding a plurality of rolls of toilet paper thereon, the support rod having an upper end with a transverse rod extending therethrough, the transverse rod extending between the pair of tabs of the upper panel of the support bracket, the transverse rod being rotatably coupled with pair of tabs, the support rod having a narrow extension extending downwardly from a lower end thereof, the narrow extension being dimensioned for being received within the recess of the lower panel.

2. A multi-roll toilet paper holding device for holding a plurality of rolls of toilet paper for easy retrieval comprising, in combination:

a support bracket including a back panel, the support bracket including upper and lower panels, the upper and lower panels extending outwardly from respective upper and lower ends of the back panel, the lower panel having a recess extending inwardly of an outer edge thereof;

a support rod pivotally coupled with respect to the support bracket, the support rod holding a plurality of rolls of toilet paper thereon, the support rod having an upper end pivotally coupled with respect to the upper panel, the support rod having a narrow extension extending downwardly from a lower end thereof, the narrow extension being dimensioned for being received within the recess of the lower panel.

3. The multi-roll toilet paper holding device as set forth in claim 2 wherein the back panel has a support pin extending outwardly from a front surface thereof intermediate the upper and lower panels.

4. The multi-roll toilet paper holding device as set forth in claim 3 wherein the support pin has a length essentially equal to a length of the upper and lower panels.

5. The multi-roll toilet paper holding device as set forth in claim 2 wherein the support rod has an upper end with a transverse rod extending therethrough, the transverse rod extending between a pair of tabs on a lower surface of the upper panel of the support bracket, the transverse rod being rotatably coupled with pair of tabs.

* * * * *